US011183790B2

(12) United States Patent
Puckel et al.

(10) Patent No.: US 11,183,790 B2
(45) Date of Patent: Nov. 23, 2021

(54) CONNECTOR HOUSING AND ELECTRICAL CONNECTOR

(71) Applicant: TE Connectivity Germany GmbH, Bensheim (DE)

(72) Inventors: Georg Puckel, Obertshausen (DE); Konrad Helmut Roth, Fraenkisch-Crumbach (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/839,880

(22) Filed: Apr. 3, 2020

(65) Prior Publication Data

US 2020/0321720 A1 Oct. 8, 2020

(30) Foreign Application Priority Data

Apr. 5, 2019 (DE) ..... 102019108978.6

(51) Int. Cl.
*H01R 13/506* (2006.01)
*H01R 13/436* (2006.01)
*H01R 13/627* (2006.01)

(52) U.S. Cl.
CPC ..... *H01R 13/4362* (2013.01); *H01R 13/506* (2013.01); *H01R 13/6271* (2013.01)

(58) Field of Classification Search
CPC ..... H01R 13/4362; H01R 13/506; H01R 13/6271
See application file for complete search history.

(56) References Cited

U.S. PATENT DOCUMENTS

| | | | | |
|---|---|---|---|---|
| 5,181,865 | A | 1/1993 | Hayes, Sr. | |
| 5,989,066 | A * | 11/1999 | Cox | H01R 13/4365 439/595 |
| 6,159,047 | A * | 12/2000 | Tanaka | H01R 13/4364 439/595 |
| 6,247,966 | B1 * | 6/2001 | Klein | H01R 13/4223 439/595 |
| 10,381,768 | B2 | 8/2019 | Kosmalski et al. | |
| 2001/0006861 | A1 * | 7/2001 | Ohsumi | H01R 13/4364 439/752 |
| 2002/0168904 | A1 * | 11/2002 | Lytle, Jr. | H01R 13/4361 439/752 |
| 2009/0081908 | A1 | 3/2009 | Martin | |

(Continued)

FOREIGN PATENT DOCUMENTS

| | | | |
|---|---|---|---|
| DE | 3526664 | A1 | 2/1986 |
| DE | 102016104303 | A1 | 9/2017 |

(Continued)

OTHER PUBLICATIONS

Extended European Search Report, dated Aug. 31, 2020, 10 pages.

(Continued)

*Primary Examiner* — Tho D Ta
(74) *Attorney, Agent, or Firm* — Barley Snyder

(57) ABSTRACT

A connector housing for an electrical connector includes a first housing having a plurality of electrical terminals and a second housing pluggable with the first housing in a translational manner. The second housing has a single secondary locking projection indirectly or directly locking at least two of the electrical terminals of the first housing in a secondary locking manner.

15 Claims, 3 Drawing Sheets

(56) References Cited

U.S. PATENT DOCUMENTS

| | | | | |
|---|---|---|---|---|
| 2015/0349449 | A1* | 12/2015 | Zhu | H01R 13/4362 439/752 |
| 2016/0285193 | A1 | 9/2016 | Iihoshi et al. | |
| 2018/0062305 | A1 | 3/2018 | Denz et al. | |
| 2019/0115693 | A1 | 4/2019 | Troeger et al. | |

FOREIGN PATENT DOCUMENTS

| | | | |
|---|---|---|---|
| DE | 102016105975 | A1 | 10/2017 |
| DE | 102017119643 | A1 | 4/2018 |
| DE | 102017111813 | A1 | 12/2018 |

OTHER PUBLICATIONS

Abstract of DE 3526664, dated Feb. 13, 1986, 1 page.
German Office Action, dated Dec. 5, 2019, 8 pages.
Abstract of DE102016104303, dated Sep. 14, 2017, 1 page.

* cited by examiner

CONNECTOR HOUSING AND ELECTRICAL CONNECTOR

CROSS-REFERENCE TO RELATED APPLICATION

This application claims the benefit of the filing date under 35 U.S.C. § 119(a)-(d) of German Patent Application No. 102019108978.6, filed on Apr. 5, 2019.

FIELD OF THE INVENTION

The present invention relates to an electrical connector and, more particularly, to a connector housing of an electrical connector.

BACKGROUND

In the electrical sector (electronics, electrical engineering, electrics, electrical power engineering, etc.), a large number of electrical connector devices or connector arrangements, bushing, pin and/or hybrid connectors, etc.—designated hereinbelow as (electrical) connectors (also: mating connectors)—are known, which serve to transmit electrical currents, voltages, signals and/or data using a large spectrum of currents, voltages, frequencies and/or data rates. In the low-, middle- or high-voltage and/or -current range, and in particular in the vehicle industry, such connectors must ensure, at short notice, a transmission of electrical power, signals and/or data in mechanically stressed, warm, possibly hot, unclean, damp and/or chemically aggressive environments permanently, repeatedly and/or after a comparatively long period of inactivity. On account of there being a large spectrum of applications, a large number of specially designed connectors is known.

Such a connector and possibly its housing which is associated with it (e.g. in the case of a connector device or a connector arrangement) or arranged over it (e.g. in the case of a connector arrangement) may be fitted on an electrical conductor, a cable, a cable harness, etc.—referred to hereafter as a made-up (electrical) cable, or to/in an electrical arrangement or device, such as e.g. to/in a housing, to/on a pressed frame, to/on a printed circuit board etc., a (power) electrical, electro-optical or electronic component or a corresponding assembly, etc. (electrical entity). If a connector (with/without housing) is located on a cable, a conductor or a cable harness, this is also known as a flying (plug-in) connector or a plug, a bushing or a coupling; if it is located at/in an electrical, electro-optical or electronic component, assembly, etc., then this is also known as a connector arrangement such as, for example, a (built-in/built-on) connector, a (built-in/built-on) plug or a (built-in/built-on) bushing. Furthermore, a connector on such an arrangement is often also identified as a (plug) receptacle, pin well, pin header or header.

Such a connector must ensure flawless transmission of electricity, wherein connectors corresponding and partly complementary to each other (connectors and mating connectors) mostly have locking and/or fastening arrangements for the permanent but generally releasable locking and/or fastening of the connector to/in the mating connector or vice versa.—Furthermore, an electrical connecting arrangement, for a connector, e.g. having or comprising an actual contact device or a contact device (terminal; usually configured materially in one piece or integrally, for example a contact element, etc.) or a contact arrangement (terminal; usually configured in multiple parts, in two parts, in one piece, materially in one piece or integrally, e.g. a one-part or multipart (crimp) contact arrangement, must be received securely therein. In the case of a (ready) made-up electrical cable, such a connecting arrangement may be provided as a connector (cf. above), i.e. without a housing, e.g. flying.

German Patent Application No. 10 2017 111 813 A1 discloses a contact housing for a connector housing of an electrical connector, in particular for a motor vehicle, with a multiplicity of electrical contact devices. The contact housing comprises two contact housing modules, with a plurality of the contact devices being able to be arranged in each contact housing module, and, by means of the contact housing modules, primary contact securing mechanisms of the contact devices are able to be arranged mutually in the contact housing modules. The primary contact securing mechanisms are configured as contact securing mechanism combs, with the contact securing mechanism comb of the first contact housing module being configured to be able to engage in the second contact housing module, and a contact securing mechanism comb of the second contact housing module being configured to be able to engage in the first contact housing module. When the two contact housing modules are in a state in which they are assembled on one another, the contact securing mechanism comb of the first contact housing module primarily locks the contact devices of the second contact housing module, and the contact securing mechanism comb of the second contact housing module primarily locks the contact devices of the first contact housing module.

Constant efforts are being made to improve electrical connectors and the terminals thereof and in particular to design them to be more robust and to configure and/or manufacture them to be less expensive. In this regard, a theme which recurs again and again is a secondary securing of a terminal (secondary contact securing mechanism) in an electrical connector, alongside a primary securing of a terminal (primary contact securing mechanism). In this case, a respective terminal firstly primarily latches in a connector housing of the connector, e.g. by means of a latching tab of the terminal at a latching shoulder in the connector housing. A secondary terminal securing mechanism secures the respective terminal a second time, or the secondary terminal securing mechanism secures the primary terminal securing mechanism.

Furthermore, in the case of electrical connectors with two terminal levels, it is often awkward to arrange a secondary terminal securing mechanism for the terminals of the respective level. In the prior art, secondary terminal securing mechanisms, which are separate or pivotably arranged on the connector and which secondarily secure the terminals by means of a rib which may engage in the connector, are often used here.

SUMMARY

A connector housing for an electrical connector includes a first housing having a plurality of electrical terminals and a second housing pluggable with the first housing in a translational manner. The second housing has a single secondary locking projection indirectly or directly locking at least two of the electrical terminals of the first housing in a secondary locking manner.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
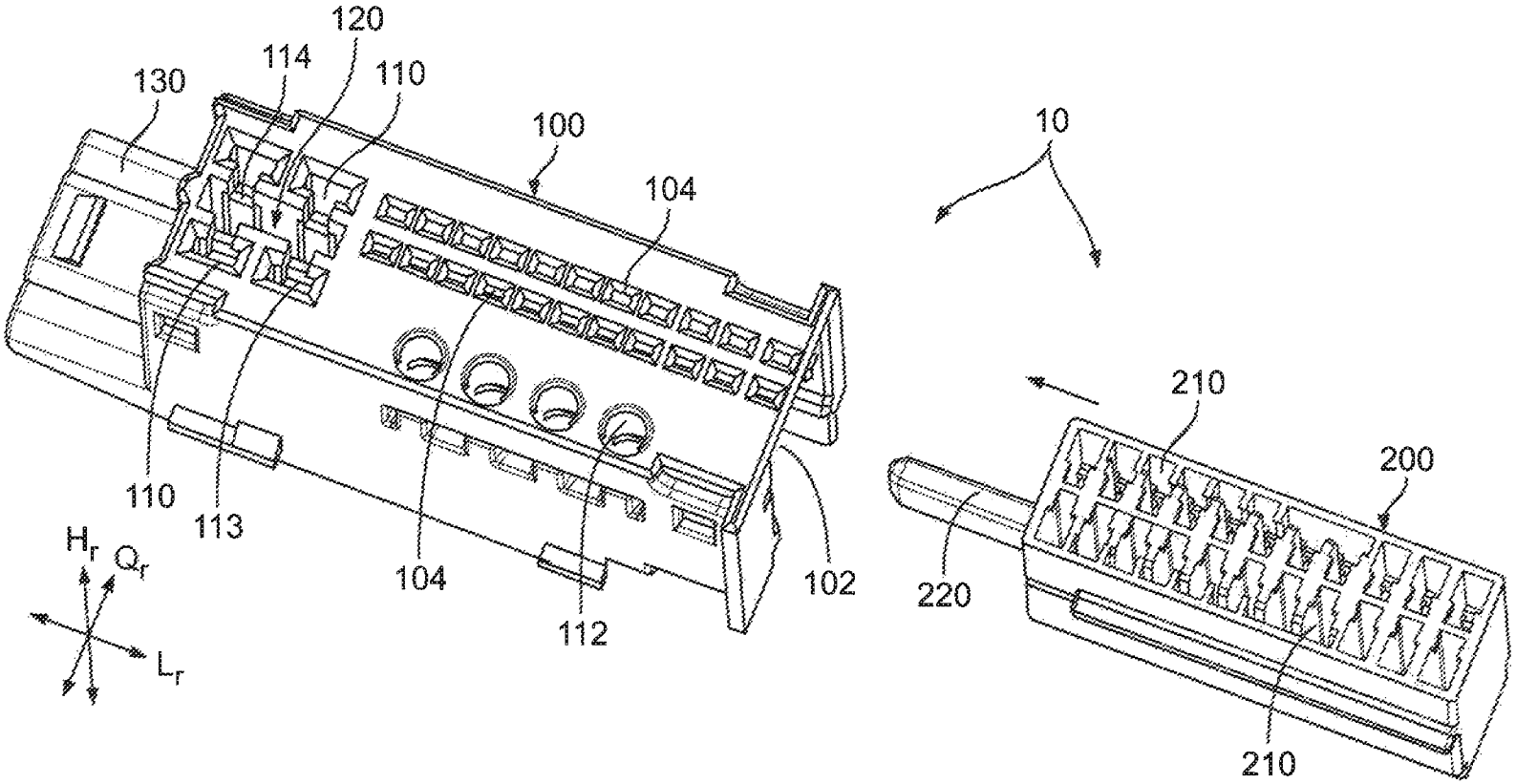
FIG. 1 is a perspective view of a base housing and a contact housing of a connector housing according to an embodiment.

The invention is explained in greater detail below using exemplary embodiments with reference to the attached schematic drawings, which are not true to scale. Sections, elements, structural parts, units, components and/or diagrams which possess an identical, univocal or analogous configuration and/or function are identified by the same reference numbers. A possible alternative which is not explained in the description and which is not illustrated in the drawings and/or which is not conclusive, a steady-state and/or kinematic reversal, a combination, etc., regarding the exemplary embodiments of the invention or a component, a diagram, a unit, a structural part, an element or a section thereof, may further be inferred from the description of the figures.

In the invention, a feature (section, element, structural part, unit, component, function, size etc.) may be configured to be positive, i.e. present, or negative, i.e. absent. In this specification, a negative feature is not explicitly explained as a feature if the invention does not place any value on it being absent. That is, the invention actually created and not devised by the prior art consists of omitting this feature.

A feature of this specification may be applied not only in a specified manner but rather may also be applied in a different manner (isolation, combination, replacement, addition, uniqueness, omission, etc.). In particular, by using a reference number and an associated feature, or vice versa, in the description, the claims and/or the drawings, it is possible to replace, add or omit a feature in the claims and/or the description. Moreover, a feature in a claim may be interpreted and/or specified in greater detail as a result.

The features of the description may also be interpreted as optional features; i.e. every feature may be understood as a non-binding feature. It is thus possible to detach a feature, optionally including its periphery, from an exemplary embodiment, with this feature then being transferable to a generalized inventive concept. The lack of a feature (negative feature) in an exemplary embodiment shows that the feature is optional with regard to the invention. Furthermore, in the case of a type term for a feature, a generic term for the feature may also be read alongside this, (optionally further hierarchical classification into subgenus, etc.), as a result of which it is possible to generalize the feature, e.g. taking into account identical effect and/or equivalence.

The invention is explained in greater detail below using examples of an embodiment (FIGS. 1 to 5) of a variant of a two-part mechanical connector housing 10 for an electrical connector 1. Although the invention is more closely described and illustrated in greater detail through described design examples, the invention is not limited by the disclosed design examples, but is rather of a more underlying nature. Other variations may be derived from this without departing from the scope of protection of the invention. The invention is thus also generally applicable to an electrical component and/or in a non-vehicle-related sector such as an electronics sector, electrical engineering sector, power engineering sector, etc., and very generally in technology. That is, the invention is generally applicable in the case of an electrical entity.

Only those spatial sections of a subject-matter of the invention which are necessary for understanding the invention are depicted in the drawings. Labels such as connectors and mating connectors, terminal and mating terminal, etc. are to be interpreted as being synonymous, i.e. are each potentially interchangeable with one another. Furthermore, the explanation of the invention below relates to (coordinate system, FIG. 1 only) a longitudinal direction Lr, a transverse direction Qr and a vertical direction Hr of the depicted embodiment of the connector housing 10.

A connector housing 10 according to an embodiment for a plurality of electrical terminals is shown in FIG. 1. In an embodiment, the connector housing 10 is used in a vehicle door or a vehicle hatch of a motor vehicle.

Figure 3:
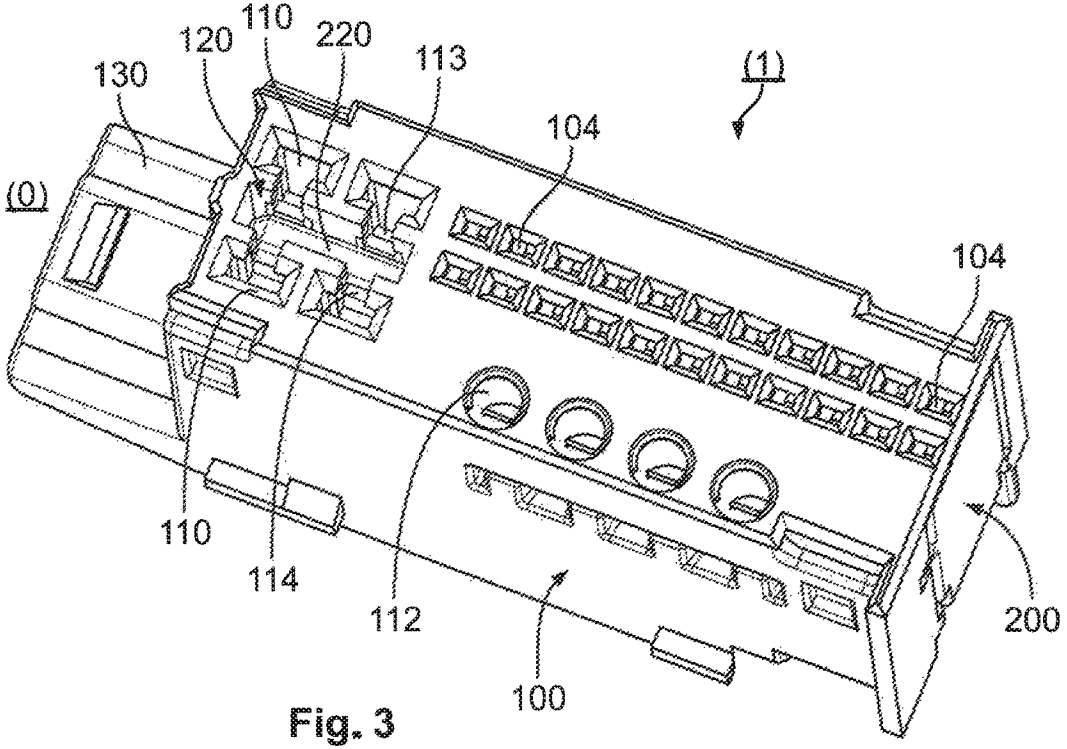
FIG. 3 is a perspective view of the connector housing of FIG. 1 in an assembled state.

The connector housing 10 and the terminals form an electrical connector 1, as shown in FIG. 3. The connector 1 may be configured as a flying connector, a built-in connector, a built-on connector, e.g. as a header. The connector 1 may have an enclosure at/in which the connector housing 10 is provided. This enclosure may be, for example, a section of a housing of an entity, which makes the connector 1 a built-in connector, for example.

If electrical conductors are further located at the terminals, then a (ready) made-up cable 0 is formed as shown in FIG. 3; such an entity is configured e.g. as an electrical device, an electrical arrangement, an electrical printed circuit board, an electrical component, an electrical module, an electrical appliance, an electrical apparatus, an electrical assembly, an electrical installation, an electrical system, etc.

The connector housing 10, as shown in FIG. 1, includes a pair of housings 100, 200 including a first housing 100 and a second housing 200. In other embodiments, it is possible to construct the connector housing 10 from more than two housings 100, 200, however, it is not possible to configure the connector housing 10 as a single housing.

In the shown embodiment, the first housing 100 is configured as a base housing 100 and the second housing 200 is configured as a contact housing 200. The contact housing 200 is distinguished in that it mainly serves to receive terminals and secondarily to latch in/on the base housing 100, with the base housing 100 having tasks which go beyond this. For example, the base housing 100 can also securely latch onto a mating connector, attach cables of the two housings 100, 200, accommodate the connector housing 10 (base housing 100 and contact housing 200) in an enclosure, etc.

In embodiments, the first housing 100 may be configured such that a plurality of terminals of at least a first general type, a first shape and/or a first specific shape size may be inserted therein, wherein the second housing 200 may be configured such that a plurality of terminals of at least a second general type, a second shape and/or a second specific shape size may be inserted therein. An individual general type of terminals is, for example, a plurality of different (shapes, specific shape sizes, etc.) pin terminals, peg terminals, tab terminals or bush terminals (but no mixture of these terminals).

The first housing 100 and/or the second housing 200 may be configured materially in one piece or integrally. An integral configuration is understood to be a configuration in which there is only one single structural part, which is virtually only separable by destroying it. The structural part is produced from a single original piece or a single original mass (molten material), which for its part, of necessity, is integral. Inner solidarity is produced by adhesion and/or cohesion. A materially (adhesively) one-piece configuration is understood to be a configuration whose individual parts are fixed onto one another by material bonding and which are not able to be separated into its individual parts without damaging one of its individual parts. Furthermore, the solidarity may be generated by a force fit and/or form-fit (not in the case of an integral configuration).

The contact housing 200, as shown in FIG. 1, is configured substantially as a cuboid shape, wherein in particular a plurality of terminal chambers 210 are arranged in the contact housing 200. The terminal chambers 210 extend in the vertical direction Hr of the contact housing 200 or of the connector housing 10 and are arranged regularly distributed in the contact housing 200. In particular, the terminal chambers 210 are arranged regularly distributed in the longitudinal direction Lr and transverse direction Qr of the contact housing 200 or of the connector housing 10 (one aligned row respectively, in total: matrix format 2x11). In other embodiments, other shapes of the contact housing 200 and arrangements of terminal chambers 210 in the contact housing 200 may be employed. The contact housing 200 is configured as an insertion housing, a plug-in housing and/or as a securing housing. Furthermore, the contact housing 200 is distinguished by the fact that it is always associated with at least one further housing.

In the embodiment shown in FIG. 1, all terminal chambers 210 of the contact housing 200 are arranged for terminals of the same grid width, with a type and/or a shape of the terminals being able to vary. If a type and shape of certain terminals is specified (which, in the present case, does not have to be all terminals of the contact housing 200), then these, due to the same grid width, are also of the same shape size. In other embodiments, it is possible e.g. to configure all of the terminal chambers 210 substantially identically, i.e. the terminals for this are all of the same type, of the same shape and of identical specific shape size. For example, MCON terminals, Get terminals etc. may be employed with the contact housing 200. Additionally or alternatively, this can, of course, also be applied to the base housing 100.

A difference between the shape size and the shape of terminals is intended to consist in a geometrically substantially identical shape with the same type (shape size), compared to an identical structural and/or geometrically similar shape with the same type (shape). That is, a plurality of terminals of a single shape size are set up for a certain grid width, are designed substantially identically in terms of their dimensions and are of the same type. Of course, terminals which do not have the same shape may also possess the same grid width, etc.

Furthermore, a difference between the shape and the type of terminals is meant to consist of a substantially identical structural and/or geometrically similar shape with the same type (shape), compared to structurally different and/or geometrically non-similar shapes with the same type (type). That is, a plurality of different terminals of a single shape may be set up for different grid widths, may be configured differently in terms of their dimensions and are of the same type.

Of course, terminals which are not of the same type may also possess the same grid width, etc.

As shown in FIG. 1, the base housing 100, with exception of a cable fastening 130, is likewise configured substantially as a cuboid shape, wherein a plurality of first terminal chambers 110 and a plurality of second terminal chambers 112 are arranged in the base housing 100. It is possible to omit the second terminal chambers 112 in an embodiment. The terminal chambers 110, 112 extend in the vertical direction Hr of the base housing 100 and of the connector housing 10, respectively, and are each arranged, in a regular arrangement, in the base housing 100, i.e. on the one hand the first terminal chambers 110 and on the other hand the second terminal chambers 112.

As shown in FIG. 1, the first terminal chambers 110 are arranged in a regular arrangement in the longitudinal direction Lr and transverse direction Qr of the base housing 100 or of the connector housing 10 (one aligned row respectively, in total: matrix format 2x2). Furthermore, the second terminal chambers 112 in particular are arranged in a regular arrangement in the longitudinal direction Lr of the base housing 100 or of the connector housing 10 (aligned row, four piece, no matrix). Here, the row of the second terminal chambers 112 is arranged in the longitudinal direction Lr and/or in the transverse direction Qr relative to the matrix of the first terminal chambers 110 in the base housing 100. In other embodiments, other forms of the base housing 100 and arrangements of terminal chambers 110, 112 in the base housing 100 may be employed.

In the embodiment shown in FIG. 1, the terminal chambers 110, 112 of the base housing 100 are each, i.e. in turn the first terminal chambers 110 on the one hand and the second terminal chambers 112 on the other hand, arranged for terminals of the same grid width, with a type and/or a shape of the terminals being identical or, if necessary, also being able to vary. If a type and shape of certain terminals is specified (which, in the present case, in turn in each case does not have to be all relevant terminals of the base housing 100), then these, due to the same grid width, are also of the same shape size. In other embodiments, it is possible to configure the respective terminal chambers 110, 112 to be different, i.e. the terminals in this case may be of a different type, different shape and/or different specific shape size.

Terminals which are compatible with e.g. FAKRA, USCAR etc., MATE-N-terminals, etc. may be employed with the base housing 100. In this case, the terminals of the base housing 100 may possess different grid widths. The base housing 100 may be configured as a housing for a hybrid connector or as a hybrid base housing. Additionally or alternatively, this can, of course, also be applied to the contact housing 200.

The base housing 100, as shown in FIG. 1, has a receptacle 102 for the contact housing 200, the receptacle 102 in the present case being arranged as a cavity 102 in the base housing 100. The contact housing 200 may be received substantially fully and/or in sections in this cavity 102 in a form-fitting manner, with the contact housing 200 being able to latch in the base housing 100. In this case, an end face of the base housing 100 may substantially align with an end face of the contact housing 200, as shown in FIG. 3. In other embodiments, the receptacle 102 may also possess a different configuration, with the contact housing 200 only being received partially in the base housing 100, for example, or may be at a distance from the base housing 100. In the latter case, the receptacle 102 may serve only as a fastening arrangement of the base housing 100 for the contact housing 200. The important thing is the ability of the two housings 100, 200 to be received or plugged together in a translational manner in a plugging direction depicted by an arrow in FIG. 1.

A plugged-together connection of the first housing 100 and the second housing 200 mounts the second housing 200 in five translational directions and/or in six rotational directions at/in the first housing 100, or vice versa. The second housing 200 is received at/in the first housing 100 at least partially in a form-fitting manner, with surfaces, which relate to one another, of the first housing 100 and of the second housing 200 being configured to be partially complementary, or vice versa.

Figure 5:
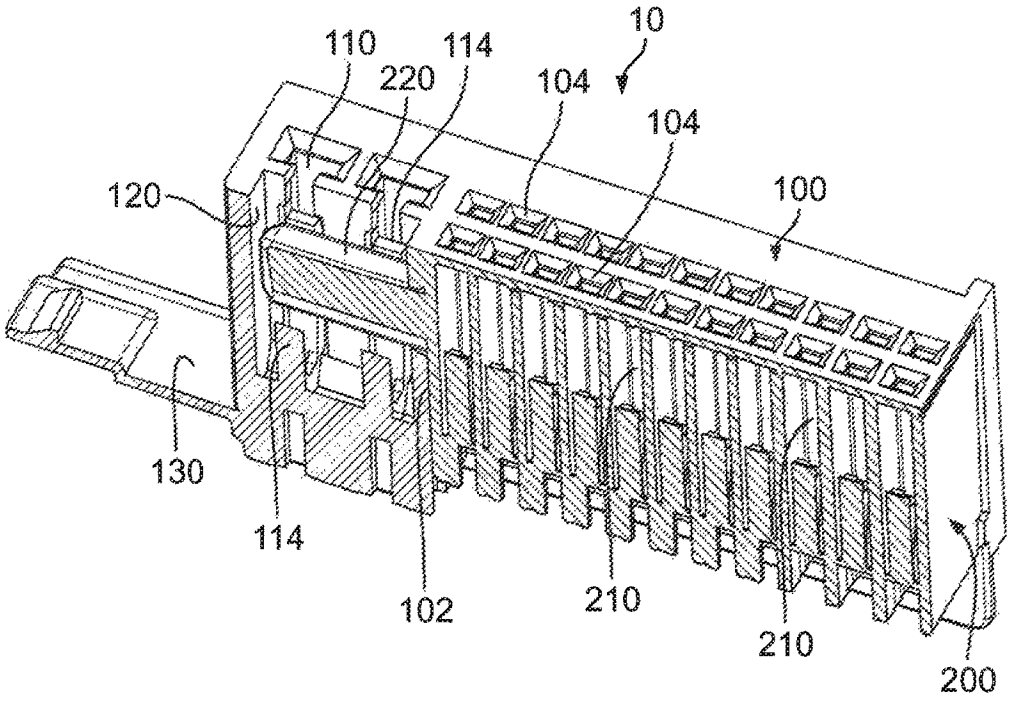
FIG. 5 is a sectional side perspective view of the connector housing of FIG. 1 in the assembled state.

As shown in FIGS. 1, 3, and 5, the base housing 100 has a ceiling wall, which limits the receptacle 102 in the vertical direction Hr. Through-recesses 104 for accesses to the terminal chambers 210 of the second housing 200 or to their terminals are arranged in the ceiling wall. In this case, the through-recesses 104, analogously to the shape of the terminal chambers 210, are arranged in the contact housing 200, in the base housing 100 or ceiling wall thereof (matrix format 2x11). In an embodiment, at an end face base, the base housing 100 may have a cable fastening 130 which is configured integrally thereon, and to which the conductors of the terminals of the base housings 100 and of the contact housing 200 may be fastened, or attached by, for example, a cable tie. In other embodiments, such a cable fastening may alternatively also be produced by the contact housing 200.

In an embodiment, the base housing 100 and the contact housing 200 have guiding arrangements which correspond to one another and are at least partially complementary, and by which the contact housing 200 may simply be plugged onto the base housing 100 or into the base housing 100. Furthermore, the base housing 100 and the contact housing 200 may have secondary locking arrangements for the respectively other housing 200/100. The base housing 100 may have a secondary locking arrangement for the terminal chambers 210 or the terminals of the contact housing 200. Moreover, the contact housing 200 may have a secondary locking arrangement for the second terminal chambers 112 or their second terminals of the base housing 100.

As shown in FIGS. 1 and 3-5, the contact housing 200 has at least one secondary locking projection 220, by which all first terminal chambers 110 of the base housing 100, or the terminals located therein, may be locked secondarily. In particular, terminals in two levels may be secondarily locked by a single such secondary locking projection 220. For this purpose, the base housing 100 has at least one secondary locking recess 120, as shown in FIGS. 1, 2, 4, and 5, for example between two rows of first terminal chambers 110, such that terminals in two levels of the base housing 100 may be secondarily locked indirectly or directly by a single secondary locking projection 220.

In other embodiments, it is possible to appropriately arrange a single secondary locking projection 220 for a single row of terminals. A plurality of secondary locking projections 220 on the contact housing 200 and a plurality of secondary locking recesses 120 for terminals in more than two levels of the base housing 100 may also be employed. In this case, a secondary locking projection 220 may also function as a secondary locking only for terminals in a single level. Such an embodiment is suitable for terminals in three levels, for example.

Figure 2:
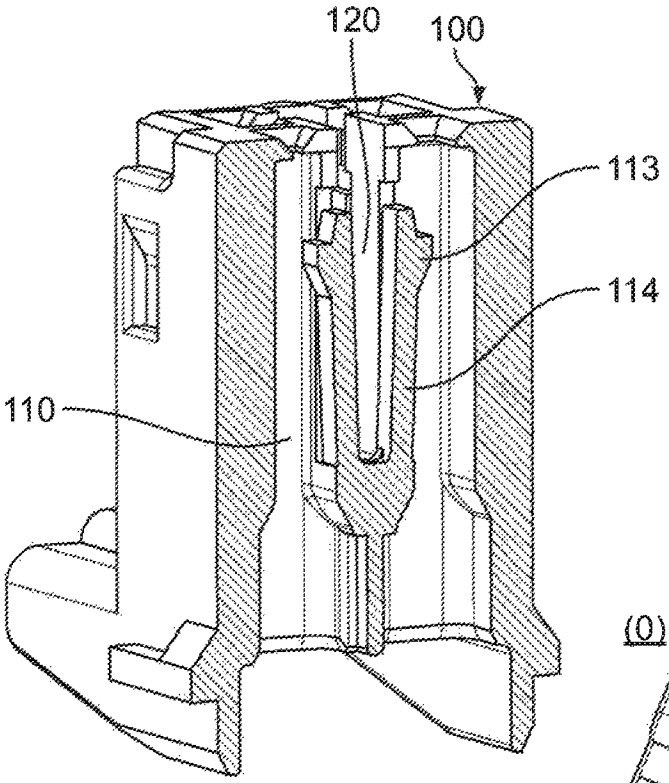
FIG. 2 is a sectional perspective view of the base housing of FIG. 1.
Figure 4:
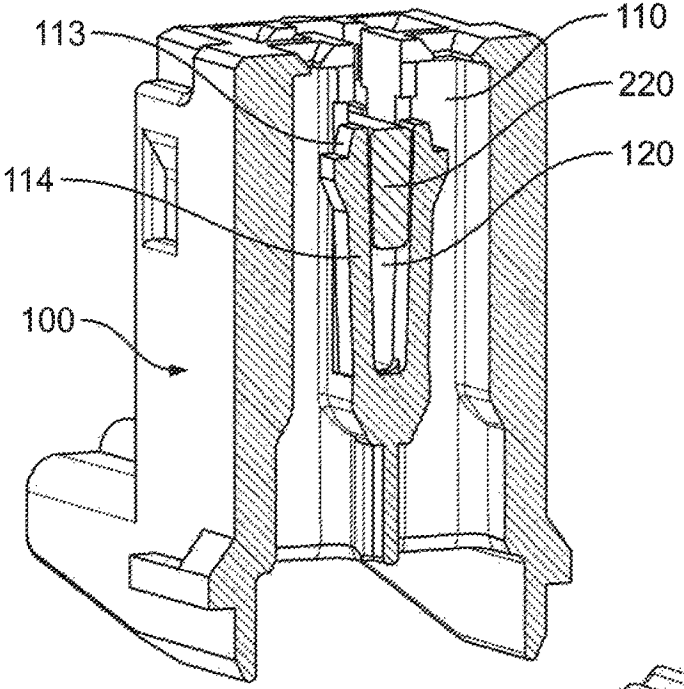
FIG. 4 is a sectional end perspective view of the connector housing of FIG. 1 in the assembled state.

When a respective terminal is plugged into a first terminal chamber 110 of the base housing 100, the terminal primarily locks in the first terminal chamber 110. In the shown embodiment, this takes place, as shown in FIGS. 2 and 4, in such a way that an inner locking spring 114 of first terminal chamber 110, by a latching region 113 configured on the chamber 110, engages in a recess of the terminal or on a latching arrangement of the terminal, such as an edge, for example, and holds the terminal in position in the first terminal chamber 110. The inner locking spring 114 forms a primary locking with the terminal. Of course, other forms of latching of a terminal in such a terminal chamber 110 may be employed. For example, it is thus possible for the relevant terminal to engage in a latching recess in an inner locking wall of the terminal chambers 110 by a latching spring configured on the terminal.

The secondary locking projection 220 locks the primary locking of a relevant terminal in its first terminal chamber 110 a second time; i.e. in a secondary locking. An inner locking wall or the inner locking spring 114 may be locked by the secondary locking projection 220. That is, the inner locking wall or the inner locking spring 114 is able to be locked, or is locked, directly and/or primarily by the secondary locking projection 220. As shown in FIG. 4, respectively two inner locking walls or inner locking springs 114, which face one another in the transverse direction of the connector housing 10, may be locked by a single section of the secondary locking projection 220 which runs in the longitudinal direction. The secondary locking projection 220 occupies a place between inner locking walls or inner locking springs 114 which face one another in the transverse direction.

As a result of the secondary locking, it is guaranteed that a terminal may only be removed from the first terminal chamber 110, e.g. with the aid of a tool, if the secondary locking projection 220 is no longer secondarily locking the primary latching mechanism. For this purpose, as shown in FIGS. 4 and 5, the secondary locking projection 220 is pushed into the secondary locking recess 120, with the secondary locking projection 220 preventing a releasing movement of the relevant inner locking spring 114. Alternatively, the secondary locking projection 220 may prevent another form of latching of a terminal in such a terminal chamber, e.g. blockade of an unlocking tool, etc.

In the shown embodiment, the secondary locking projection 220 is configured integrally on the contact housing 200 and, relative to a side of the contact housing 200, is at right angles to the contact housing 200, as shown in FIGS. 1 and 5. In the present case, the secondary locking projection 220 extends in the longitudinal direction Lr and is configured on an end face base on the contact housing 200. The secondary locking recess 120 extends between two rows of the first terminal chambers 110 along the inner locking springs 114 of the first terminal chambers 110, as shown in FIGS. 2 and 4, and into the base housing 100, as shown in FIGS. 3 and 5.

The secondary locking projection 220 and the secondary locking recess 120 are configured in the longitudinal direction Lr in sections and in the circumferential direction of the secondary locking projection 220 in a form-fitting manner in regions, as shown in FIG. 4. In the present case, a cross-section of the secondary locking projection 220, with the exception of rounded corner regions, is configured substantially rectangular or, in a slight deviation from this, slightly trapezoidal. In other embodiments, other shapes may be employed. The secondary locking projection 220 may have an elongated shape and/or e.g. a substantially quadrilateral, substantially rectangular, substantially trapezoidal or substantially triangular cross-section. The secondary locking recess 120 may possess a design which is analogous to this at least in regions (circumferential direction of the secondary locking projection 220) and/or in sections (longitudinal direction of the secondary locking projection 220).

The advantageous configurations and/or developments of the invention which are explained above and/or below in the claims may be employed individually or in any desired combination with one another, unless, for example, they are unambiguously dependent on one another or where there are incompatible alternatives.

What is claimed is:

1. A connector housing for an electrical connector, comprising:

a first housing having a plurality of first terminal chambers receiving a plurality of first electrical terminals; and a second housing pluggable with the first housing in a translational manner and having a plurality of second terminal chambers receiving a plurality of second electrical terminals, the second housing has a single secondary locking projection indirectly or directly locking at least two of the first electrical terminals of the first housing in a secondary locking manner.

2. The connector housing of claim 1, wherein the secondary locking projection is plugged into a secondary locking recess of the first housing.

3. The connector housing of claim 1, wherein the secondary locking projection is plugged into the first housing between a pair of levels of the first housing, with at least one of the plurality of first electrical terminals locked in each of the pair of levels.

4. The connector housing of claim 1, wherein the secondary locking projection is formed integrally on a section of the second housing.

5. The connector housing of claim 1, wherein the first housing and/or the second housing is formed materially in one piece or integrally.

6. The connector housing of claim 1, wherein the first terminal chambers are lockable by the secondary locking projection and the first housing has an additional terminal chamber disposed alongside the first terminal chambers.

7. The connector housing of claim 1, wherein the first housing or the second housing has a cable fastening for attaching a plurality of cables.

8. The connector housing of claim 1, wherein the first housing is a base housing and the second housing is a contact housing.

9. The connector housing of claim 1, wherein one of the first terminal chambers receives one of the plurality of first electrical terminals, the first terminal chamber has an inner locking wall or an inner locking spring with a latching region.

10. The connector housing of claim 9, wherein the one of the plurality of first electrical terminals is locked in a primary locking manner by the latching region, the inner locking wall or the inner locking spring is locked by the secondary locking projection.

11. The connector housing of claim 1, wherein the plurality of first terminal chambers are arranged in a matrix that aligns substantially in a longitudinal direction and a transverse direction of the connector housing.

12. The connector housing of claim 11, wherein the secondary locking projection extends substantially in the longitudinal direction, the secondary locking projection is plugged in between the first terminal chambers of the first housing that are staggered in the transverse direction.

13. An electrical connector, comprising:

a plurality of first electrical terminals;

a plurality of second electrical terminals; and a connector housing including a first housing having a plurality of first terminal chambers receiving the first electrical terminals and a second housing pluggable with the first housing in a translational manner, the second housing having a plurality of second terminal chambers receiving the second electrical terminals, the second housing has a single secondary locking projection indirectly or directly locking at least two of the first electrical terminals of the first housing in a secondary locking manner.

14. The electrical connector of claim 13, further comprising an enclosure at or in which the connector housing is disposed.

15. A made-up electrical cable or electrical entity, comprising:

an electrical connector including a plurality of first electrical terminals, a plurality of second electrical terminals, and a connector housing, the connector housing including a first housing having a plurality of first terminal chambers receiving the first electrical terminals and a second housing pluggable with the first housing in a translational manner, the second housing having a plurality of second terminal chambers receiving the second electrical terminals, the second housing has a single secondary locking projection indirectly or directly locking at least two of the first electrical terminals of the first housing in a secondary locking manner.

* * * * *